US006112958A

United States Patent [19]

LaMacchia et al.

[11] Patent Number: 6,112,958

[45] Date of Patent: Sep. 5, 2000

[54] COMBINATION BRACELET FASTENER BUTTON HOOK, AND ZIPPER PULL

[76] Inventors: Ralph LaMacchia, 16 Harmon Dr., Huntington, N.Y. 11743; Barbara Bush, 123 Colony Dr., Holbrook, N.Y. 11741

[21] Appl. No.: 09/209,744

[22] Filed: Dec. 11, 1998

[51] Int. Cl.[7] ..... A47G 25/80

[52] U.S. Cl. ..... 223/111; 294/2

[58] Field of Search ..... 223/111, 1; 294/2, 294/3, 3.6, 24

[56] References Cited

U.S. PATENT DOCUMENTS

| | | | |
|---|---|---|---|
| 416,932 | 12/1889 | Mabie | 24/40 |
| 1,841,291 | 1/1932 | Kern | 132/75 |
| 2,974,991 | 3/1961 | Gerrick | 294/3.6 |
| 5,855,401 | 1/1999 | Papernik | 294/2 |

*Primary Examiner*—Bibhu Mohanty
*Attorney, Agent, or Firm*—Galgano & Burke

[57] ABSTRACT

A combination bracelet, button, and zipper fastening device includes an elongated handle having a first end and a second end with a first releasable clamping means coupled to the first end and a removable, reversible end cap on the second end. The first releasable clamping means are operable to releasably hold at least one interlocking member of a releasable clasp of a bracelet. The removable, reversible end cap has a button hook and a chain attached to one end and an interlocking member on the other end. A second releasable clamping means is attached to the end of the chain. The handle is sized and configured to be held in a hand of a person so that the first clamping means is positioned to rest on a wrist adjoining the hand holding the handle so that a person using the bracelet fastening device can hold and position with one hand at least one interlocking member of the releasable clasp on the adjoining wrist while using the other free hand to fasten the other interlocking member of the clasp therewith to securely retain the bracelet around the wrist. The handle includes a hollow which is accessible from the second end and which is dimensioned to store the second clamping means, the chain, and the button hook.

13 Claims, 3 Drawing Sheets

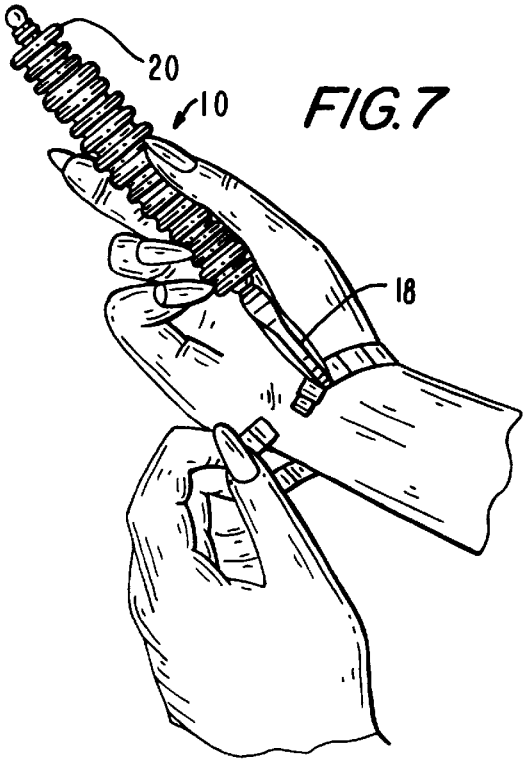
FIG.7
FIG.8
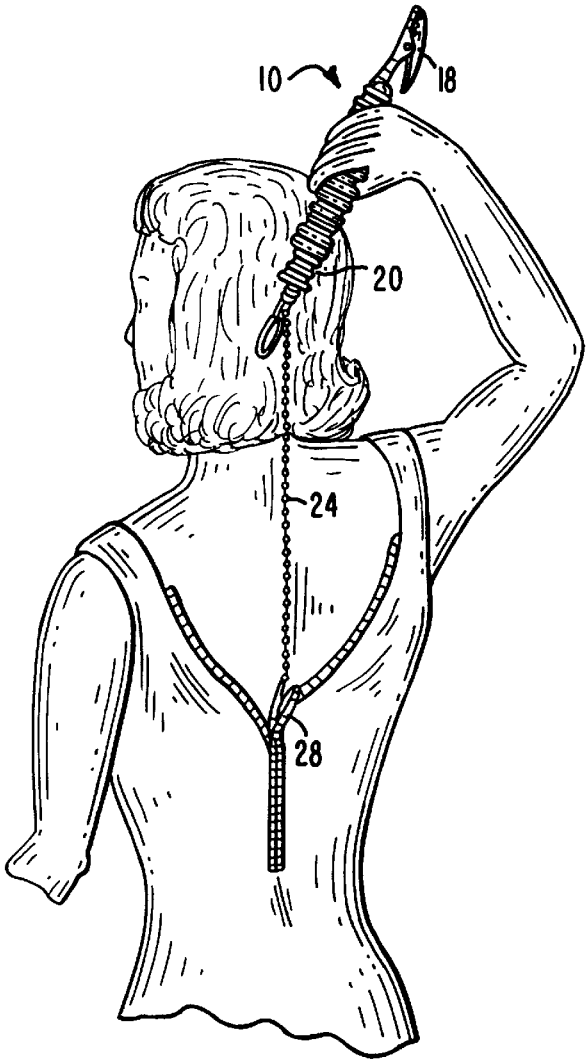
FIG.9
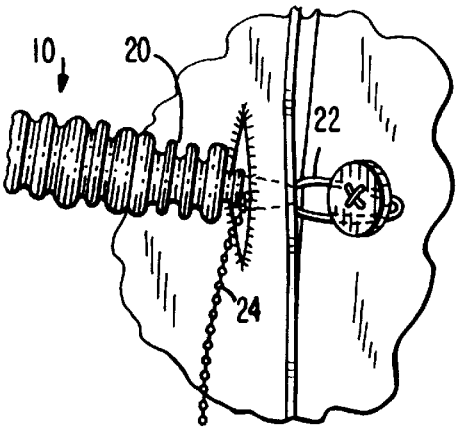

COMBINATION BRACELET FASTENER BUTTON HOOK, AND ZIPPER PULL

RELATED PATENT

This application is related to co-owned U.S. Pat. No. 5,707,327 the complete disclosure of which is hereby incorporated herein by reference

BACKGROUND OF THE INVENTION

1. Field of the Invention

The present invention relates generally to a device for use in fastening jewelry, buttoning buttons, and zipping zippers. More particularly, the present invention relates to a combination device for use in assisting a person in fastening a bracelet around his or her wrist, for fastening buttons through buttonholes, and for closing zippers, particularly zippers located on the back portion of clothing 2. State of the Art Jewelry, such as rings, broaches, necklaces, and bracelets, is widely used by women and men for ornamentation. Particularly, bracelets are ornamental bands or chains, or string of beads or pearls worn around a person's wrist. Although, some bracelets are formed from various materials into the shape of a continuous band that is slid over a person's hand, most bracelets have a releasable clasp for connecting together the two ends of the bracelet to securely retain the bracelet around a person's wrist.

A typical clasp has a first interlocking member and a second releasably operable, usually spring biased, interlocking member, each of which is attached to opposite ends of a bracelet. An example of a typical clasp, for connecting the ends of a bracelet and securing the bracelet around a person's wrist, generally consists of a small continuous ringlet or loop at one end of the bracelet and a releasably operable hook or loop attached at the other end of the bracelet. The releasably operable hook interlocks with the ringlet to connect the two ends of the bracelet together.

Another example of a typical clasp, for use in connecting the ends of a bracelet and securing the bracelet around a person's wrist, generally includes a receiving member having a cavity attached at one end the bracelet and a mating member having an insertable projection attached at the other end of the bracelet. Either of the receiving or the mating members can be releasably operable. The mating member interlocks with the receiving member to connect the two ends of the bracelet together. Various other configurations of releasable clasps have been devised for connecting the ends of a bracelet together and retain it around a person's wrist.

A major problem with a bracelet having a releasable clasp is in the effort required by a person to easily and quickly fasten the bracelet around his or her wrist. Manually fastening a bracelet around one's wrist requires an individual to exhibit great dexterity. First, the hand, adjoining the wrist upon which the bracelet is to be worn, is often of no help in manipulating the clasp. Often, a person must solely use one hand, the hand opposite from the wrist to which the bracelet is to be worn, to hold the first interlocking member in place on their wrist while attempting to connect the second usually releasably operable interlocking member. Frequently, a person needs to try several times in order to successfully connect the clasp of the bracelet when trying to fasten it around his or her wrist.

My prior U.S. Pat. No. 5,709.327 discloses a bracelet fastening device to assist a person in quickly and easily fastening a bracelet around his or her own wrist. The device overcomes the problems associated with fastening a bracelet around one's own wrist without the assistance of another person and particularly by a person with impaired fine motor skills. The device generally includes a handle and releasable clamping means operably attached to the handle. The clamping means is operable to releasably hold at least one interlocking member of a releasable clasp of a bracelet. The handle is sized and configured to be held in a hand of a person so that the clamping means is positioned to rest on a wrist adjoining the hand holding the handle. A person using the bracelet fastening device can hold and position with one hand at least one interlocking member of the releasable clasp on the adjoining wrist while using the other free hand to fasten the other interlocking member of the clasp therewith to securely retain the bracelet around the wrist.

I have recognized that, in addition to fastening bracelets, difficulties are presented in the operations of fastening buttons and closing zippers. Buttons are difficult to manipulate for many people with impaired motor skills and zippers are particularly difficult to close when located on the back portion of clothing, for example on the back of a woman's dress.

SUMMARY OF THE INVENTION

It is an object of the present invention to provide a bracelet fastening device that attaches to and holds a bracelet in place while enabling a person to quickly and easily connect the clasp to fasten a bracelet around his or her own wrist.

It is also an object of the present invention to provide such a bracelet fastening device for use by a person in which the bracelet fastening device assists in overcoming the problems associated with fastening a bracelet around one's own wrist without the assistance of another person.

It is another object of the present invention to provide such a bracelet fastening device for use by a person with impaired fine motor skills in which the device assists in fastening a bracelet around one's own wrist.

It is another object of the present invention to provide such a bracelet fastening device that holds one of the interlocking members forming a clasp of a bracelet so that it can be positioned on one's wrist while the person's other free hand connects the other interlocking member to it.

It is also an object of the present invention to provide a button fastening device that attaches to and pulls a button through a buttonhole.

It is also an object of the present invention to provide such a button fastening device for use by a person in which the button fastening device assists in overcoming the problems associated with fastening a button through a buttonhole.

It is another object of the present invention to provide such a button fastening device for use by a person with impaired fine motor skills in which the device assists in fastening a button through a buttonhole.

It is also an object of the present invention to provide a zipper fastening device that attaches to and pulls a zipper closed.

It is also an object of the present invention to provide such a zipper fastening device for use by a person in which the zipper fastening device assists in overcoming the problems associated with fastening a zipper on the back portion of an article of clothing.

It is still another object of the present invention to provide a combination bracelet, button, and zipper fastening device that is constructed to be light, durable and portable and easily held and used.

It is still yet another object of the present invention to provide a combination bracelet, button, and zipper fastening device that is simple in construction and which may be manufactured relatively simply and inexpensively.

In accord with these objects which will be discussed in detail below, the combination bracelet, button, and zipper fastening device of the present invention includes an elongated handle having a first end and a second end with a first releasable clamping means coupled to the first end and a removable, reversible end cap on the second end. The first releasable clamping means are operable to releasably hold at least one interlocking member of a releasable clasp of a bracelet. The removable, reversible end cap has a button hook and a chain attached to one end and an interlocking member on the other end. A second releasable clamping means is attached to the end of the chain. The handle is sized and configured to be held in a hand of a person so that the first clamping means is positioned to rest on a wrist adjoining the hand holding the handle so that a person using the bracelet fastening device can hold and position with one hand at least one interlocking member of the releasable clasp on the adjoining wrist while using the other free hand to fasten the other interlocking member of the clasp therewith to securely retain the bracelet around the wrist. The handle includes a hollow which is accessible from the second end and which is dimensioned to store the second clamping means, the chain, and the button hook.

Preferably, the handle is an elongate member having a generally circular cross-section. Desirably, the handle and the clamping means are fabricated from plastic. Preferably, each clamping means includes a first clamping member and a second clamping member. Advantageously, the second clamping member includes a generally U-shaped biasing member attached to the second clamping member.

Additional objects and advantages of the invention will become apparent to those skilled in the art upon reference to the detailed description taken in conjunction with the provided figures.

BRIEF DESCRIPTION OF THE DRAWINGS

FIG. 7 is a broken perspective view illustrating the combination bracelet, button, and zipper fastener of the invention in use fastening a bracelet;

FIG. 8 is a broken perspective view illustrating the combination bracelet, button, and zipper fastener of the invention in use fastening a zipper; and FIG. 9 is a broken perspective view illustrating the combination bracelet, button, and zipper fastener of the invention in use fastening a button.

DETAILED DESCRIPTION OF THE PREFERRED EMBODIMENTS

Figure 1:
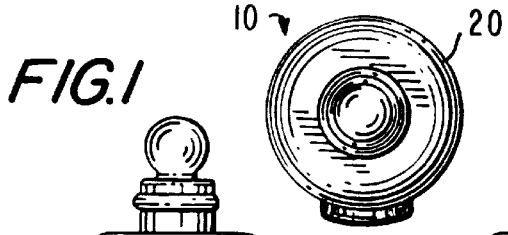
FIG. 1 is an end view of the second end of the combination bracelet, button, and zipper fastener of the invention.
Figure 2:
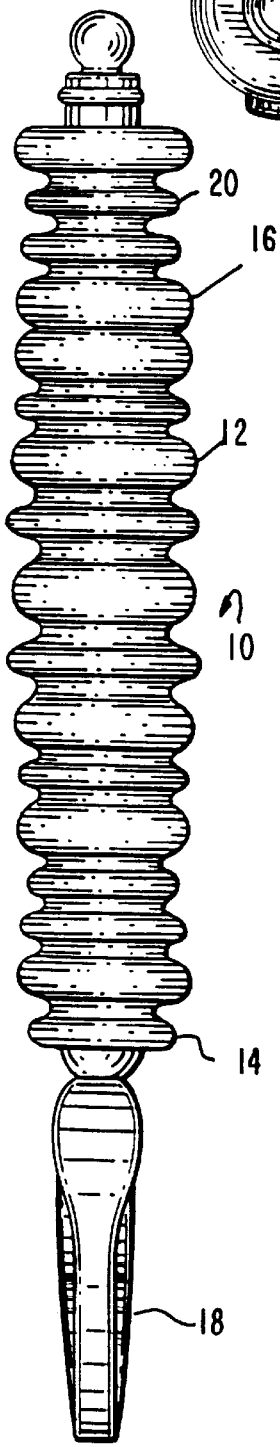
FIG. 2 is a top view of the combination bracelet, button, and zipper fastener of the invention.
Figure 3:
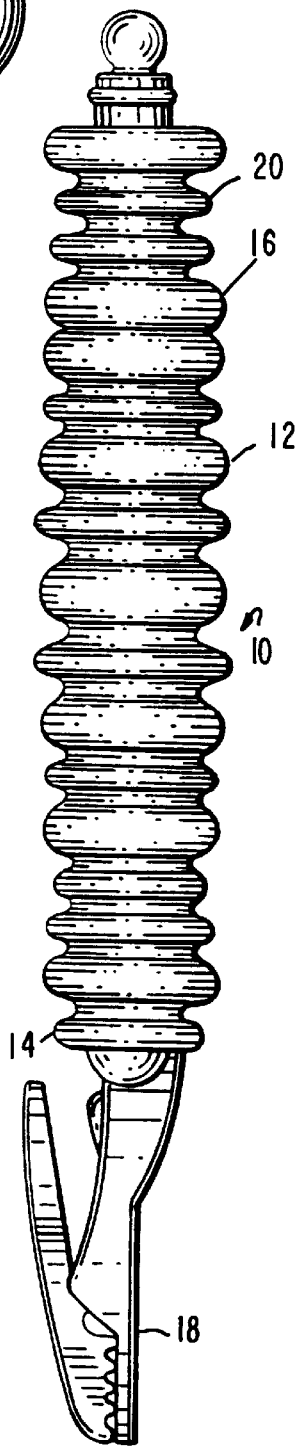
FIG. 3 is a side view of the combination bracelet, button, and zipper fastener of the invention.
Figure 4:
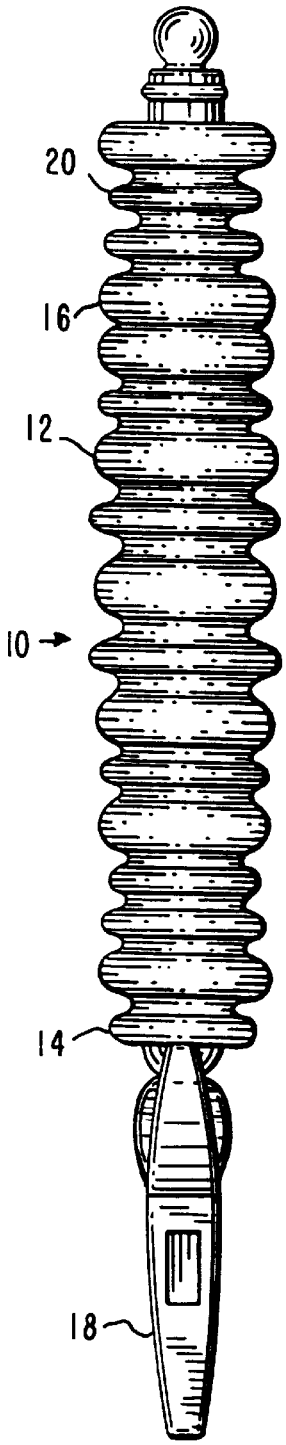
FIG. 4 is a bottom view of the combination bracelet, button, and zipper fastener of the invention.
Figure 5:
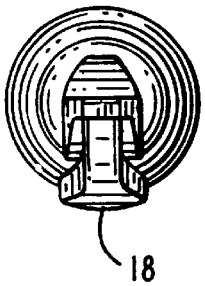
FIG. 5 is an end view of the first end of the combination bracelet, button, and zipper fastener of the invention.

Referring now to FIGS. 1 through 6, the combination bracelet, button, and zipper fastening device 10 of the present invention includes an elongated handle 12 having a first end 14 and a second end 16 with a first releasable clamping means 18 coupled to the first end 14 and a removable, reversible end cap 20 on the second end 16. The first releasable clamping means 18 is operable to releasably hold at least one interlocking member of a releasable clasp of a bracelet as shown and described below with reference to FIG. 7.

Figure 6:
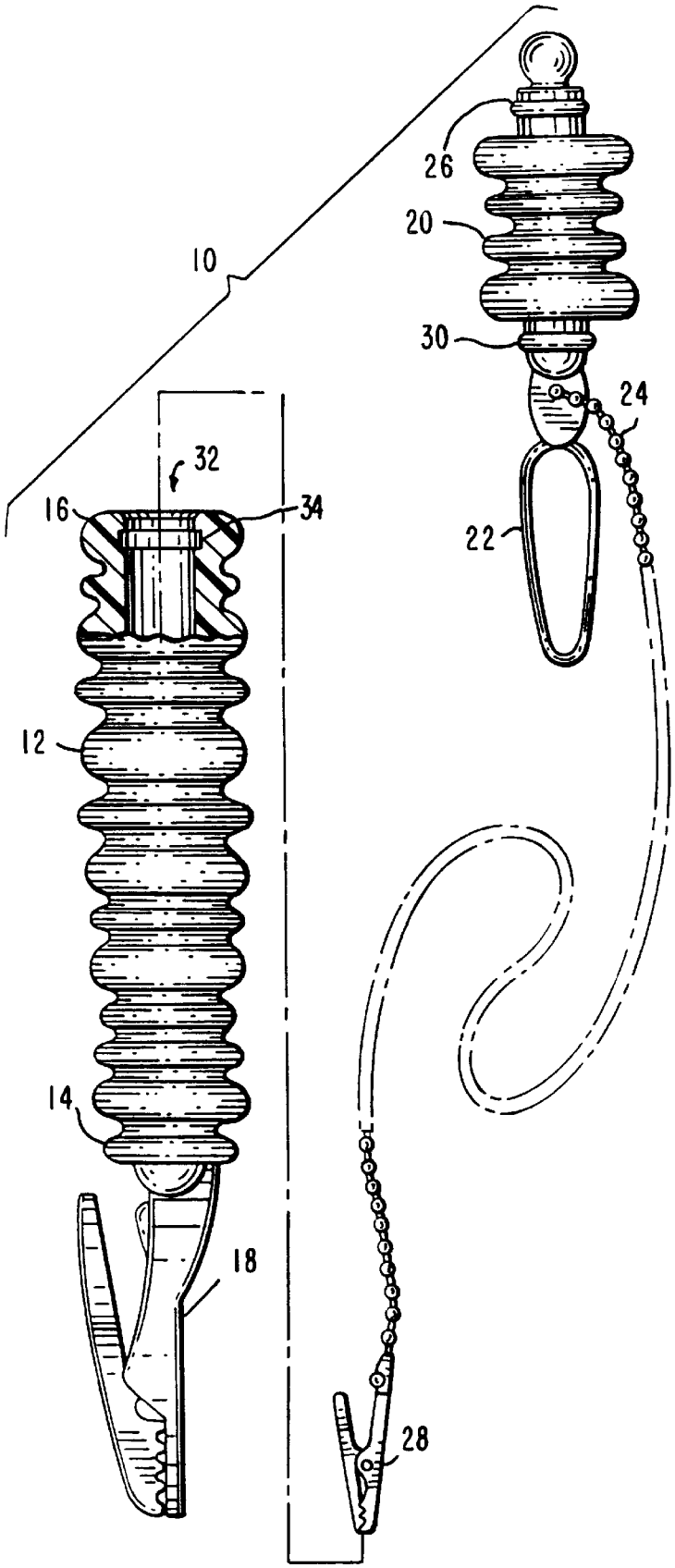
FIG. 6 is a side view in partial section showing the removable, reversible end cap removed from the handle.

As seen best in FIG. 6, the removable, reversible end cap 20 has a button hook 22 and a chain 24 attached to one end and a first interlocking member 26 on the other end. A second releasable clamping means 28 is attached to the free end of the chain 24. A second interlocking member 30 is also provided on the same end as the button hook 22. The handle 12 includes a hollow 32 which is accessible from the second end 16 and which is dimensioned to store the second clamping means 28, the chain 24, and the button hook 22. The interior of the hollow 32 is provided with an interlocking structure 34 which is designed to engage the interlocking structures 26 and 30 to hold the end cap 20 in both of its reversible positions.

According to the presently preferred embodiment, the locking structures 26, 30, 34 are "friction fit" tongue and groove structures and the clamping means 18, 28 are commonly known as "alligator clips". It will be appreciated, however, that the second clamping means may be embodied as a type of hook which engages the hole in a zipper pull. The chain 24 may be made of metal or synthetic material and may be a "cable" or a "string" rather than a "chain" so long as it is generally elongate and flexible. As mentioned above, the entire device is advantageously made of synthetic material.

As shown best in FIG. 7, the handle 12 is sized and configured to be held in a hand of a person so that the first clamping means 18 is positioned to rest on a wrist adjoining the hand holding the handle so that a person using the bracelet fastening device can hold and position with one hand at least one interlocking member of the releasable clasp on the adjoining wrist while using the other free hand to fasten the other interlocking member of the clasp therewith to securely retain the bracelet around the wrist.

The zipper fastener and the button fastener are accessed by removing the end cap 20 from the second end 16 of the handle 12 as shown in FIG. 6 and by, optionally, inserting the interlocking structure 26 into the hollow 32 of the handle 12 until it interlocks with the interlocking structure 34 in the handle 12.

As shown in FIG. 8, the alligator clip 28 is attached to a zipper and the end cap 20 preferably with the handle 12 attached to it is pulled from over the shoulder in order to close the zipper on the back of a dress for example. It will be appreciated that both hands may be used to attach the alligator clip 28 to the zipper. Optionally, a hook could be substituted for the alligator clip 28.

As shown in FIG. 9, the button hook 22 is placed through a button hole and a button is placed inside the hook. The end cap 20 preferably with the handle 12 attached to it is pulled pulling the button through the button hole.

When the button hook and zipper fastener are not in use, they are stored in the hollow 32 of the handle 12 with the interlocking structure 30 of the end cap 20 engaging the interlocking structure 34 of the hollow 32.

It should be noted that the provision of the reversible end cap 20 allows the user to grip the relatively long handle for all three intended applications as shown in FIGS. 7–9. This is particularly important for persons having arthritis and who have difficulty grasping small objects or tools.

There has been described and illustrated herein a combination bracelet, button, and zipper fastening device. While particular embodiments of the invention have been described, it is not intended that the invention be limited thereto, as it is intended that the invention be as broad in scope as the art will allow and that the specification be read likewise. It will therefore be appreciated by those skilled in the art that yet other modifications could be made to the provided invention without deviating from its spirit and scope as so claimed.

What is claimed is:

1. A combination bracelet and zipper fastening device, comprising:

(a) an elongated handle having a first end and a second end with a hollow within said handle, said hollow being accessible from said second end;

(b) first clamping means attached to said first end, said first clamping means being an alligator clip;

(c) a removable, reversible end cap removably coupled to said second end, said end cap having two friction-fit locking structures for engaging said hollow and holding said end cap in two opposite orientations, said locking structures comprising one of a tongue and a groove.

2. A combination device as claimed in claim 1, wherein:

said zipper engaging member is an alligator clip.

3. A combination device as claimed in claim 1, further comprising:

f) a button hook coupled to said end cap.

4. A combination device according to claim 3, wherein:

said button hook and said elongate flexible member are coupled to the same side of said end cap.

5. A combination device according to claim 1, wherein:

said handle and said end cap are made of synthetic material.

6. A combination device according to claim 1, wherein:

said handle and said end cap have substantially circular cross sections.

7. A combination bracelet, button and zipper fastening device, comprising:

(a) an elongated handle having a first end and a second end with a hollow within said handle, said hollow being accessible from second end;

(b) first clamping means attached to said first end, said first clamping means being an alligator clip;

(c) a removable, reversible end cap removably coupled to said second end, said end cap having two friction-fit locking structures for engaging said hollow and holding said end cap in two opposite orientations, said locking structures comprising one of a tongue and a groove;

(d) an elongate flexible member coupled to said end cap;

(e) a button hook coupled to said end cap; and (f) a zipper engaging member coupled to said elongate flexible member, wherein said hollow is dimensioned to receive said elongate flexible member and said zipper engaging member.

8. A combination device as claimed in claim 1, wherein:

said zipper engaging member is an alligator clip.

9. A combination device according to claim 7, wherein:

said button hook and said elongate flexible member are coupled to the same side of said end cap.

10. A combination device according to claim 7, wherein:

said handle and said end cap are made of synthetic material.

11. A combination device according to claim 7, wherein:

said handle and said end cap have substantially circular cross sections.

12. A combination device according to claim 11 wherein:

said tongue comprises an annular rib on said end cap and said tongue comprises an annular inner groove formed in said handle which opens onto said hollow thereof adjacent to said second end thereof.

13. A combination device according to claim 8 wherein:

said tongue comprises an annular rib on said end cap and said tongue comprises an annular inner groove formed in said handle which opens onto said hollow thereof adjacent to said second end thereof.

* * * * *